US007104877B1

(12) United States Patent
Terry

(10) Patent No.: US 7,104,877 B1
(45) Date of Patent: Sep. 12, 2006

(54) DUST CONTAINMENT APPARATUS FOR DRYWALL SANDING

(76) Inventor: Mark E. Terry, 633 Ensign Ave., Beachwood, NJ (US) 08722

( * ) Notice: Subject to any disclaimer, the term of this patent is extended or adjusted under 35 U.S.C. 154(b) by 0 days.

(21) Appl. No.: 11/328,602

(22) Filed: Jan. 11, 2006

(51) Int. Cl.
*B24B 27/08* (2006.01)
*B24D 15/00* (2006.01)

(52) U.S. Cl. ..... 451/354; 451/453; 451/456

(58) Field of Classification Search ..... 451/456, 451/453, 451, 354, 351, 350, 523–525
See application file for complete search history.

(56) References Cited

U.S. PATENT DOCUMENTS 4,062,152 A * 12/1977 Mehrer ..... 451/344
4,697,389 A * 10/1987 Romine ..... 451/354
5,527,212 A * 6/1996 Bowen et al. ..... 451/456
5,540,616 A * 7/1996 Thayer ..... 451/354
5,624,305 A * 4/1997 Brown ..... 451/354
6,860,799 B1 * 3/2005 Loveless ..... 451/354
6,988,940 B1 * 1/2006 Taylor ..... 451/354

* cited by examiner

*Primary Examiner*—Dung Van Nguyen
(74) *Attorney, Agent, or Firm*—Charles I. Brodsky

(57) ABSTRACT

Drywall sanding apparatus employing a spring tensioned frame surround about its sanding component to capture substantially all generated dust within a collecting bag secured with said frame, to be thereafter emptied.

20 Claims, 5 Drawing Sheets

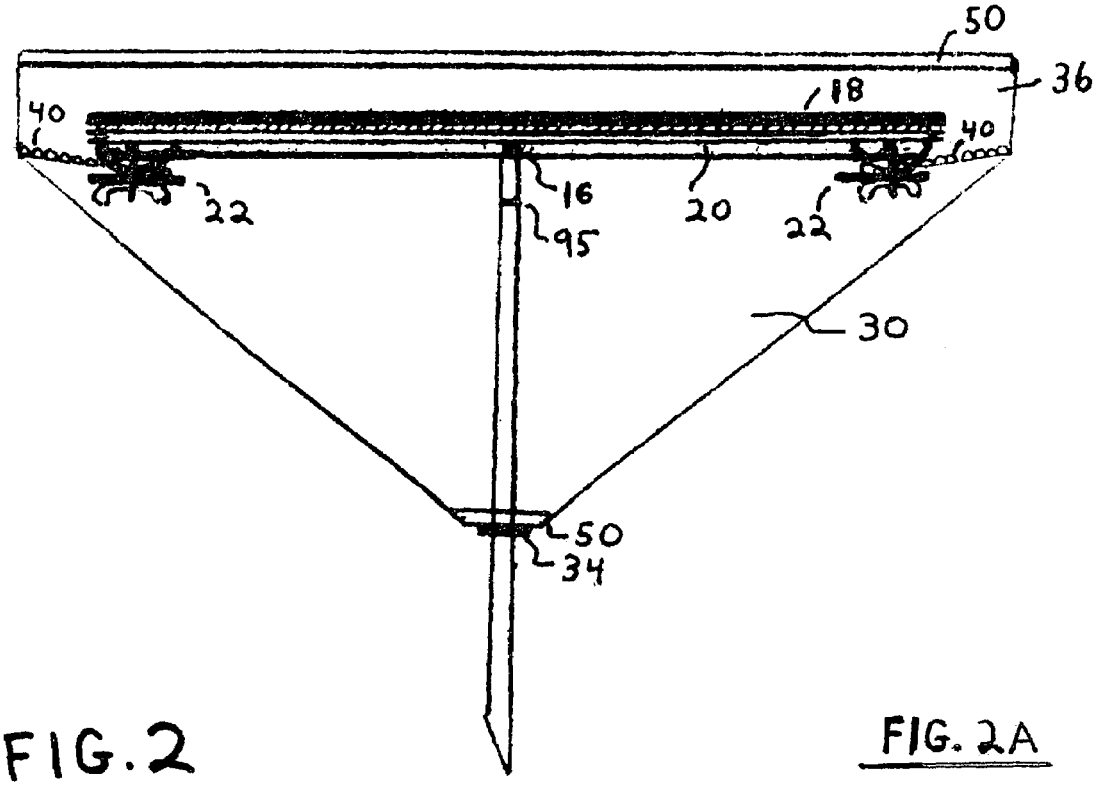
FIG. 2
FIG. 2A
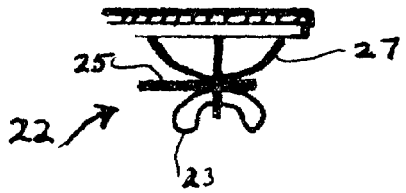
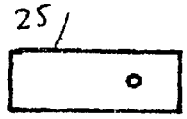
FIG. 2B

FIG. 3
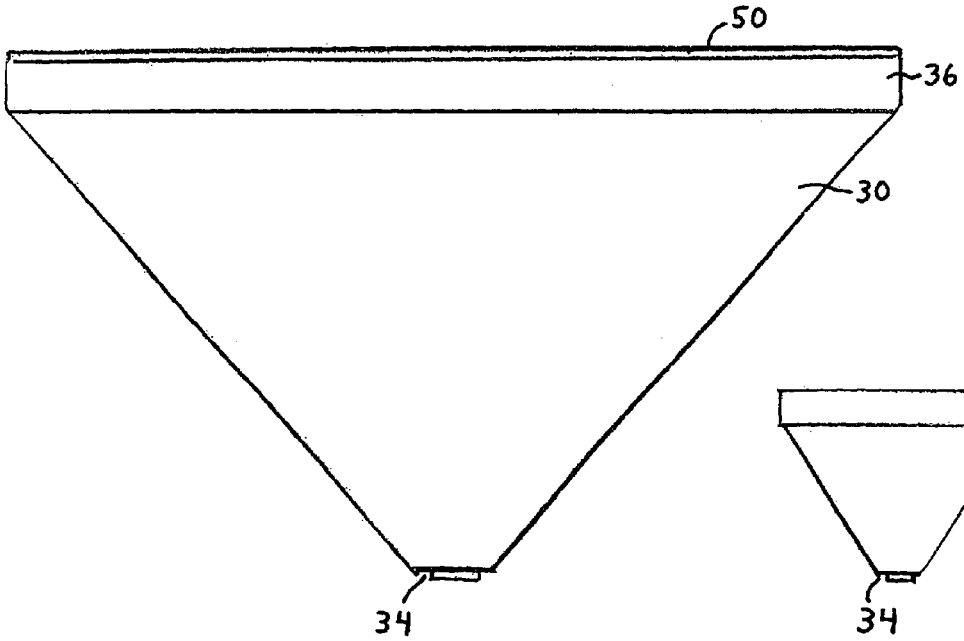
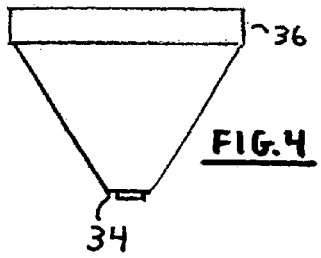
FIG. 4
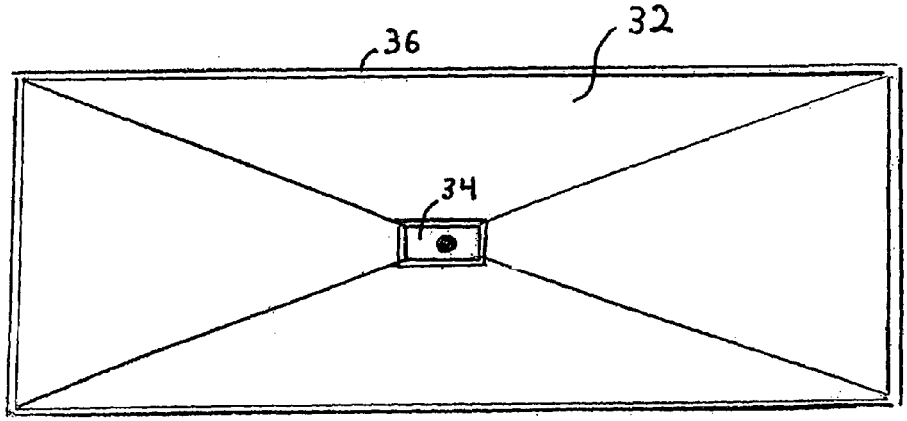
FIG. 5

DUST CONTAINMENT APPARATUS FOR DRYWALL SANDING

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the sanding of drywalls, in general, and to the collection and containment of spackle compound dust generated thereby, in particular.

2. Description of the Related Art

As will be appreciated, a major concern in the drywall sanding of walls and ceilings is the generation and collection of airborne created spackle compound dust. Whether the sanding takes place during residential or commercial construction, remodeling or rehabilitation, the problem of drywall spackle dust has been both a cosmetic and health problem for some time. Power sanders with vacuum and hose attachments have been widely advertised, but suffer the disadvantages that they are large, cumbersome to use, and very costly.

OBJECTS OF THE INVENTION

It is an object of the present invention, therefore, to provide a new and improved drywall sanding apparatus small in size, simple to use, and far less costly in price.

It is object of the invention, also, to provide such sanding apparatus that can be utilized in a manner which is less labor intensive, both as to the time having to be expended, and the effort having to be put in.

It is another object of the invention to provide such improved drywall sanding apparatus by which the drywall spackle dust generated can be both easily collected and easily disposed of.

It is a further object of the invention to essentially minimize the mess when sanding spackle compound through a capture of substantially all the dust that is generated.

SUMMARY OF THE INVENTION

As will become clear from the following description, the drywall sanding apparatus of the invention employs a spring tensioned frame surround about the sanding component which is employed to encapsulate substantially all the spackle compound dust within a collecting bag which can then be thereafter emptied.

In one preferred embodiment of the invention, a standard drywall sanding pole is provided having a first end and a swivel sanding component at a second end. A pair of clamps or other holding devices are secured to an underside of the sanding component, and a collecting bag having an open top and an apertured bottom is included to receive the first end of the drywall sanding pole when passed through the aperture. A frame joined with the open top of the collecting bag and of dimension greater than that of the sanding component is utilized, with a pair of expandable springs, each of which is secured at its opposite ends to the frame and with one of the pair of clamps. By applying pressure on the sanding pole to actuate the sanding component along a flat surface to be sanded, a tension is created by an expansion of the springs to close the open top of the collecting bag about the surfaces. (Depending upon the configuration of the drywall sanding component, a second pair of clamps and a second pair of expandable springs may be employed in securing the sanding component within the frame, as when the sanding component is of a rectangular configuration.)

To close off the collecting bag in capturing sanded spackle compound, a gasket is first employed at the apertured bottom of the collecting bag. Secondly, with the frame enclosing the sanding component including a pliable surrounding flange at an upper end, pressing the frame flat against the wall or ceiling to be sanded, effectively seals the bag. In this construction, the collecting bag is preferably of a flexible and collapsible composition so that an inexpensive, lightweight overall manufacture is had. By lifting the frame away from the wall or ceiling after the sanding has been completed, the pole (with its collecting bag and captured dust) can simply be carried away and shaken into a trash container to discharge the dust, or simply shaken off. Experience has shown that such removal off the flat surface should be done smoothly, and preferably not suddenly, to minimize the possibility of the accumulated dust falling free.

As will be appreciated by those skilled in the art, a second version of the invention allows for retrofitting with the standard type of drywall sanding poles already being manufactured and sold. There, the pair(s) of springs are already secured at one end to the frame, with their opposite end(s) being attachable to an underside of the swivel sanding component of the drywall pole. In this manner, all that would be required would be to secure the pair(s) of the clamps at an underside of the sanding component, to receive the free end of the spring(s) to ready the frame and its joined collecting bag for use in capturing the sanded spackle compound dust.

With both constructions, the tension design of the spring holds the frame of the sanding bag tight to the drywall walls and ceilings being sanded, with the generated dust then be captured in the bag below.

BRIEF DESCRIPTION OF THE DRAWINGS

These and other features of the invention will be more clearly understood from a consideration of the following description, taken in connection with the accompanying drawings, in which:

FIG. 2 is a front sectional view of the drywall sanding apparatus, which along with the insets of FIG. 2*a* and FIG. 2*b*, is helpful in an understanding of its construction;

FIGS. 3–5 illustrate front, side and top views of a flexible, collapsible collecting bag utilized in the drywall sanding apparatus of the invention;

DETAILED DESCRIPTION OF THE INVENTION

Figure 1:
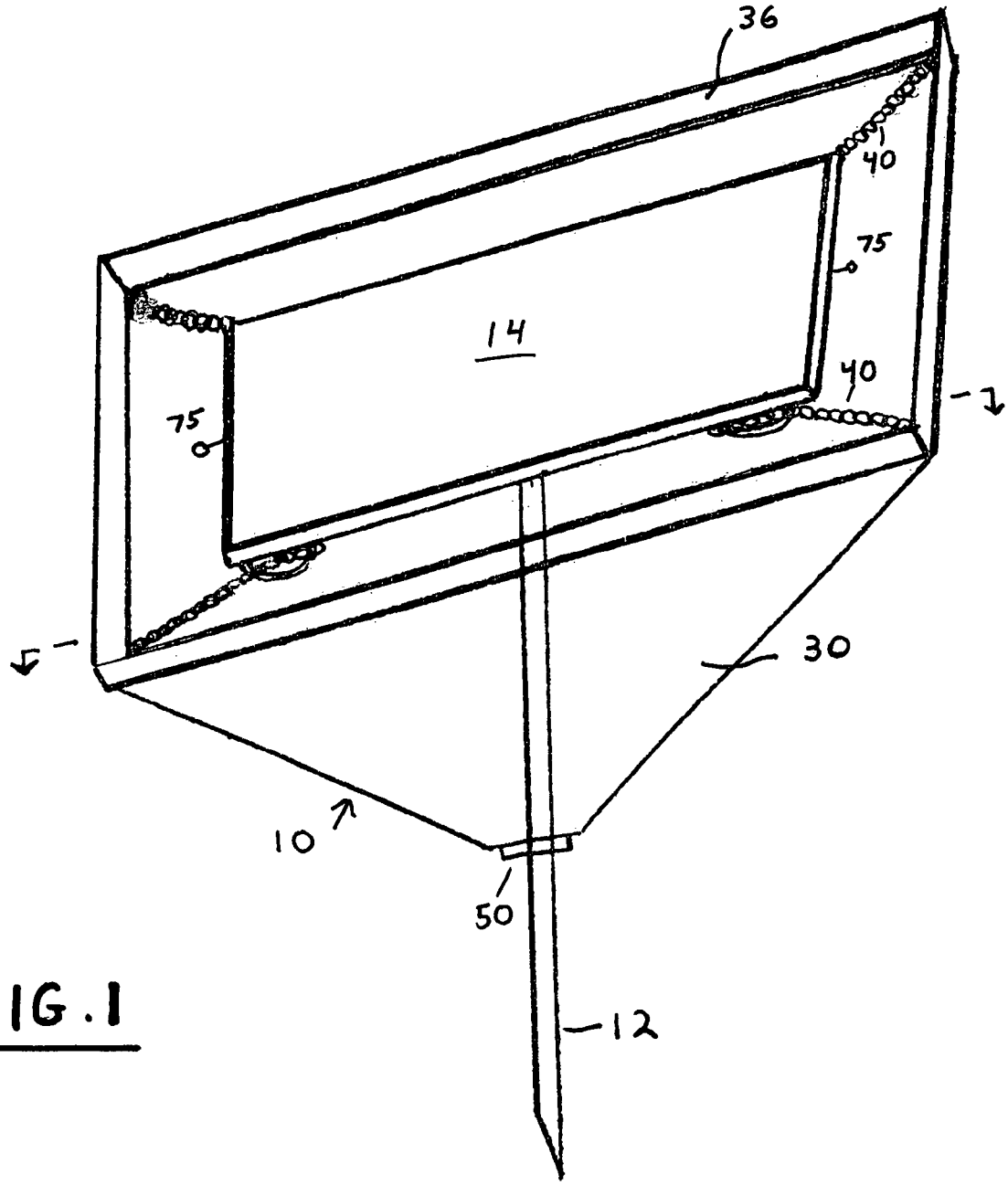
FIG. 1 is a top perspective view of the drywall sanding apparatus embodying the teachings of the present invention.
Figure 6:
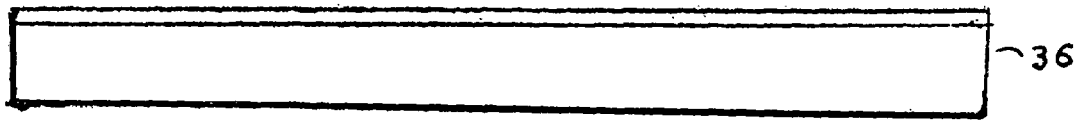
FIGS. 6 and 7 are front and top views, respectively, of a frame illustrating one arrangement of springs which connect with the swivelled sanding component of the drywall sanding apparatus.
Figure 7:
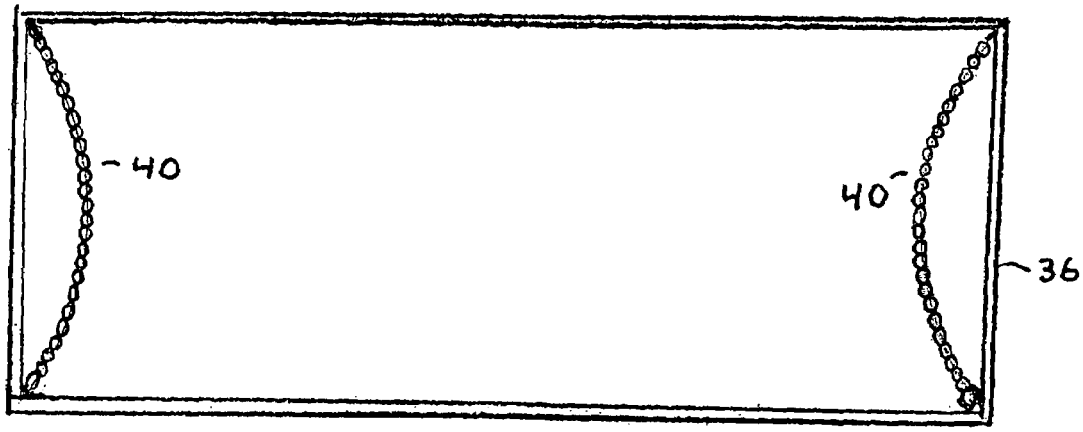

In the drawings, the drywall sanding apparatus 10 includes a drywall sanding pole 12 having a sanding component 14 adjustable left-and-right, forward-and-back about a swivel 16. With the component 14 having a sanding surface 18 and an underside 20, the apparatus of the invention includes a pair of clamps (or like holding devices) 22 secured at the underside 20 of the sanding component 14. Four such clamps are illustrated in the configuration of FIG. 1 for a rectangular configuration of the sanding component 14, although the operation of the present invention will operate in the manner to be described with only a single such pair of clamps provided, as at 75 in FIG. 1. The drywall sanding apparatus 10 then incorporates a collecting bag 30 having an open top 32 (FIG. 5) and an apertured bottom 34 (FIGS. 3–5), with the open top 32 being joined with a frame 36 whose dimensions are greater than that of the sanding component 14. Two pairs of expandable springs 40 are permanently secured at both ends to the frame 36, as in FIGS. 6 and 7, to be wrapped around a clip 25 as described below. In the quiescent condition of the drywall sanding apparatus, ready for use, the positioning of the springs, the clamps, and the sanding component within the frame is as shown in FIG. 2. (As will be appreciated, only one pair of expandable springs 40 are required where the sanding component 14 is provided with the single pair of clamps 75.) As shown in FIG. 2 and at its insets FIGS. 2*a* and 2*b*), a preferred embodiment of the clamp 22 includes a wing nut 23 securing clip 25 against a sandpaper holding bracket 27 at an extension to allow a wrapping of the spring 40 around the clip 25 to be there held in place.

As the collecting bag 30 is intended to retain the sanding spackle compound dust, and as the sanding pole 12 passes through the apertured bottom 34 of the bag 30, a gasket 50 is employed to close off the apertured bottom 34 to contain the dust in place—the gasket 50 being preferably of a foam composition (FIG. 2). To facilitate storage when not in use, the collecting bag 30 may be of a flexible and collapsible composition (e.g. cloth or light plastic), and the sanding pole 12 may be sectionalized, to telescope to different lengths, as indicated at 95 in FIG. 2.

Figure 8:
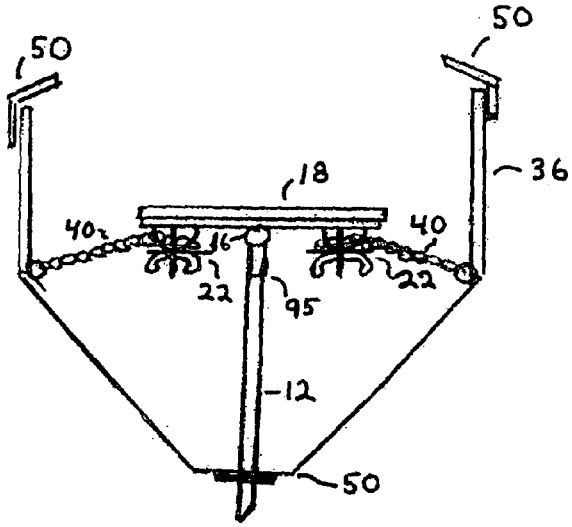
FIGS. 8 and 9 are illustrations helpful in an understanding as to how the application of pressure on the sanding pole actuates the sanding component of the drywall sanding apparatus to fit flush against a flat wall or ceiling surface in use, with the frame and collecting bag providing a sealed, encapsulated area for the spackle compound dust generated.
Figure 9:
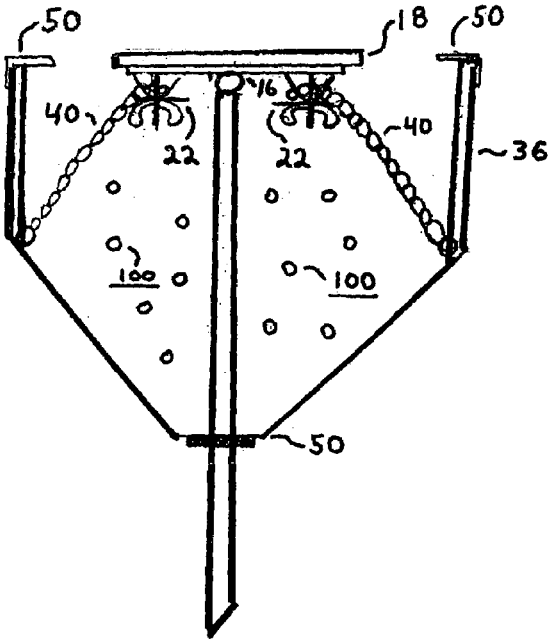

FIGS. 8 and 9 illustrate the operation which follows according to the invention when pushing upwardly, for example, on the sanding pole 12 for sanding the spackle compound on a ceiling when using the frame 36 of the invention, particularly with a surround flange 50 of a pliable composition. As the pole 12 is pushed upwardly, the springs expand and the flange 50 (which then contacts the ceiling) begins to compress (FIG. 8). When pushing upwardly to contact the ceiling with the sanding component surface 18, the frame 36 with its flange 50 then are positioned to lie flush with the ceiling as the springs 40 expand to allow the sanding to take place. With the frame 36 and the flange 50 flush with the ceiling, any dust generated during the sanding then falls into the collecting bag, as shown at 100 in FIG. 9, where it is retained in place, being substantially sealed in position by the gasket 50. When the sanding apparatus is withdrawn from the ceiling—or from a wall when sanding there—, the sanding component 14 recedes back to the quiescent position of FIG. 2 by the compression of the springs 40—and the pole 12, with the bag 30 in place—, can then be carried to a location for subsequent emptying.

And, as will be appreciated, were one to already possess a typical, prior art sanding pole, all that would be necessary would be to obtain the frame 36, the collecting bag 30, the springs 40, and the appropriate clamps or other manner of securement so as to join the springs with the underside of the swivel sanding component of the already possessed sanding pole to carry out the teachings of the invention as described.

Experience has shown that with this method of sanding, substantially all of the spackle compound dust is collected. The apparatus is easy to carry, easy to utilize, and quite inexpensive in manufacture. The spring tension design creates the tight seal to the surface being sanded and substantially all the drywall wall or ceiling dust is collected in the bottom of the bag 30.

While there have been described what are considered to be preferred embodiments of the present invention, it will be readily appreciated by those skilled in the art that modifications can be made without departing from the scope of the teachings herein. Thus, instead of wrapping the springs 40 about the extensions of clip 25 to be held there in place, the advantages that accrue to the invention will also be seen to follow, for example, where the springs 40 secure with hooks or similar holdings devices extending from designed locations on the frame 36. For at least such reason, therefore, resort should be had to the claims appended hereto for a true understanding of the invention.

I claim:

1. Dust containment apparatus for a drywall sanding pole having a swivel sanding component at one end thereof, comprising:

a pair of clamping devices securable at an underside of said sanding component;

a collecting bag having an open top and an apertured bottom to receive an opposite end of said drywall sanding pole when passed therethrough;

a frame joined with the open top of said collecting bag and of dimension greater than that of said sanding component;

and a pair of expandable springs, each secured to said frame and attachable with one of said pair of clamping devices to be held in place thereby.

2. The apparatus of claim 1 wherein said collecting bag is flexible and collapsible.

3. The apparatus of claim 2 wherein said collecting bag is composed of one of cloth and light plastic.

4. The apparatus of claim 2, also including a gasket at said apertured bottom of said collecting bag, and wherein said frame includes a surrounding flange at an upper end thereof.

5. The apparatus of claim 1, also including a gasket at said apertured bottom of said collecting bag.

6. The apparatus of claim 5 wherein said gasket is of a foam composition.

7. The apparatus of claim 1 wherein said frame includes a surrounding flange at an upper end thereof.

8. The apparatus of claim 7 wherein said surrounding flange is of a pliable composition.

9. The apparatus of claim 1, including a second pair of clamping devices securable at an underside of said sanding component, and a second pair of expandable springs, each of said second pair of expandable springs being secured to said frame and attachable with one of said second pair of clamping devices to be held in place thereby.

10. The apparatus of claim 9 wherein said collecting bag is flexible and collapsible, also including a gasket at said apertured end of said collecting bag, and wherein said frame includes a surrounding flange at an upper end thereof.

11. Drywall sanding apparatus comprising:

a drywall sanding pole having a first end and a swivel sanding component at a second end;

a pair of clip extensions secured to an underside of said sanding component;

a collecting bag having an open top and an apertured bottom to receive said first end of said drywall sanding pole;

a frame joined with the open top of said collecting bag and of dimension greater than that of said sanding component;

and a pair of expandable springs, each secured at opposite ends thereof to said frame and each wound about one of said pair of clip extensions to be held in place thereby;

the apparatus being so constructed and arranged that by applying pressure on the sanding pole to actuate the sanding component along a flat surface to be sanded, a tension is created by an expansion of the springs to close the open top of the collecting bag about the flat surface.

12. The apparatus of claim 11, also including a gasket at said apertured bottom of said collecting bag so as to substantially seal the collecting bag about the flat surface to be sanded.

13. The apparatus of claim 12 wherein said gasket is of a foam composition.

14. The combination of claim 12 wherein said collecting bag is flexible and collapsible and wherein said frame includes a surrounding flange at an upper end thereof.

15. The apparatus of claim 11 wherein said collecting bag is flexible and collapsible.

16. The apparatus of claim 15 wherein said collecting bag is composed of one of cloth and light plastic.

17. The apparatus of claim 11 wherein said frame includes a surrounding flange at an upper end thereof.

18. The apparatus of claim 17 wherein said surrounding flange is of a pliable composition.

19. The apparatus of claim 11, including a second pair of clip extensions secured to an underside of said sanding component, and a second pair of expandable springs, each secured at opposite ends thereof to said frame and each wound about one of said second pair of clip extensions to be held in place thereby.

20. The apparatus of claim 19, also including a gasket at said apertured bottom of said collecting bag so as to substantially seal the collecting bag about the surface to be sanded, wherein said collecting bag is flexible and collapsible, and wherein said frame includes a pliable surrounding flange at an upper end thereof.

* * * * *